US006118735A

United States Patent [19]

Li

[11] Patent Number: 6,118,735

[45] Date of Patent: Sep. 12, 2000

[54] CLOCK WITH REPLACEMENT DIAL PLATE

[75] Inventor: Yuan-Chi Li, Taichung, Taiwan

[73] Assignee: Jing Chen Industrial Co., Ltd., Taiwan

[21] Appl. No.: 09/271,076

[22] Filed: Mar. 17, 1999

[51] Int. Cl.[7] ..... G04B 19/06

[52] U.S. Cl. ..... 368/228; 368/232

[58] Field of Search ..... 368/223, 228–229, 368/232–236

[56] References Cited

U.S. PATENT DOCUMENTS 5,008,869 4/1991 Dueck ..... 368/228

5,168,479 12/1992 Lima ..... 560/232

*Primary Examiner*—Vit Miska

*Attorney, Agent, or Firm*—Trop, Pruner & Hu, P.C.

[57] ABSTRACT

A clock includes a housing with a receiving space and a slit extending along a portion of a surrounding wall thereof in a plane. A clock mechanism is fixed on a central area of the receiving space, and has a spindle with an axis normal to the plane. An elongated positioning member includes an abutment portion which is disposed above the clock mechanism and which has a through hole for passage of the spindle therethrough for mounting time indicating hands thereon, and an anchoring portion which extends from the abutment portion in a radial direction relative to the axis. The anchoring portion has right and left lateral sides opposite to each other and parallel to the radial direction. A dial plate is insertable into the receiving space via the slit along the plane, and has an inner periphery extending inwardly in the radial direction to confine a notch with two inner edge portions opposite to each other so as to mate respectively with the right and left lateral sides.

4 Claims, 10 Drawing Sheets

CLOCK WITH REPLACEMENT DIAL PLATE

BACKGROUND OF THE INVENTION

1. Field of the Invention

This invention relates to a clock, more particularly to a clock with a replaceable dial plate.

2. Description of the Related Art

A conventional clock generally has a housing and a dial which is secured in the housing and which may have patterns for decorative purpose. It is noted that the dial cannot be detached from the clock, thereby resulting in a monotonous appearance for the clock.

SUMMARY OF THE INVENTION

The object of the present invention is to provide a clock with a replaceable dial plate which can be detached from a housing of the clock.

According to this invention, the clock includes a housing with a rear wall, a surrounding wall which extends forwardly from a periphery of the rear wall in an axial direction to cooperate with the rear wall to confine a receiving space, and a slit which extends along a portion of the surrounding wall in a plane. A clock mechanism has a casing which is fixed on a central area of the rear wall in the receiving space, and a spindle which is rotatable relative to and which extends outwardly of the casing with an axis normal to the plane. An elongated positioning member includes an abutment portion which is disposed above the casing and which has a through hole for passage of the spindle therethrough so as to be adapted for mounting time indicating hands thereon, and an anchoring portion which extends from the abutment portion in a radial direction relative to the axis. The anchoring portion has right and left lateral sides opposite to each other and parallel to the radial direction. At least one dial plate has an outer periphery of such a dimension so as to be insertable into the receiving space via the slit along the plane, and an inner periphery which extends inwardly in the radial direction from the outer periphery to confine a notch with two inner edge portions opposite to each other so as to mate respectively with the right and left lateral sides of the anchoring portion. By virtue of sliding engagement between the inner edge portions and the right and left lateral sides, the dial plate can be guided for insertion into and removal from the receiving space in the radial direction for easy and convenient replacement of the dial plate.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
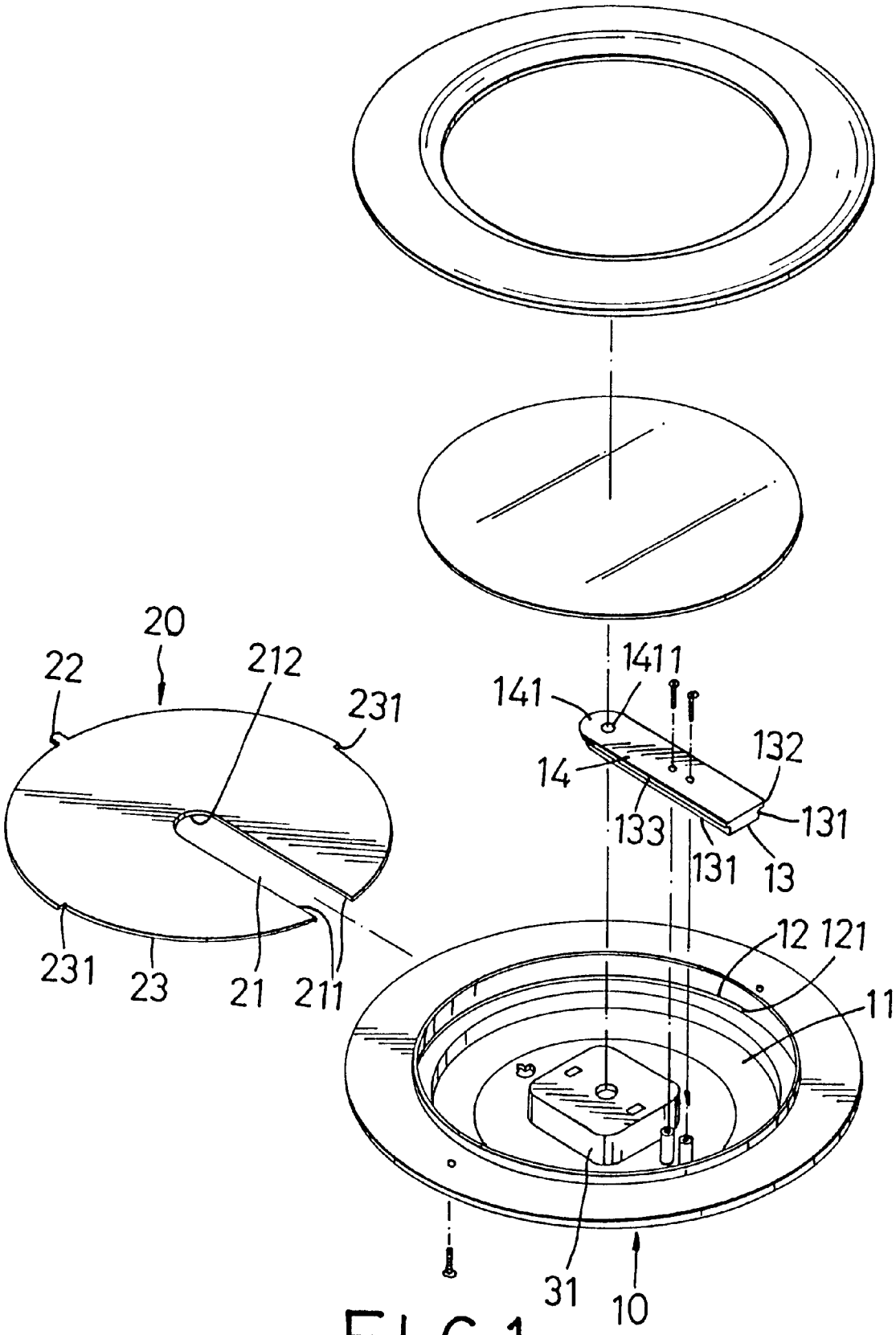
FIG. 1 is an exploded view of a first preferred embodiment of a clock according to this invention.
Figure 4:
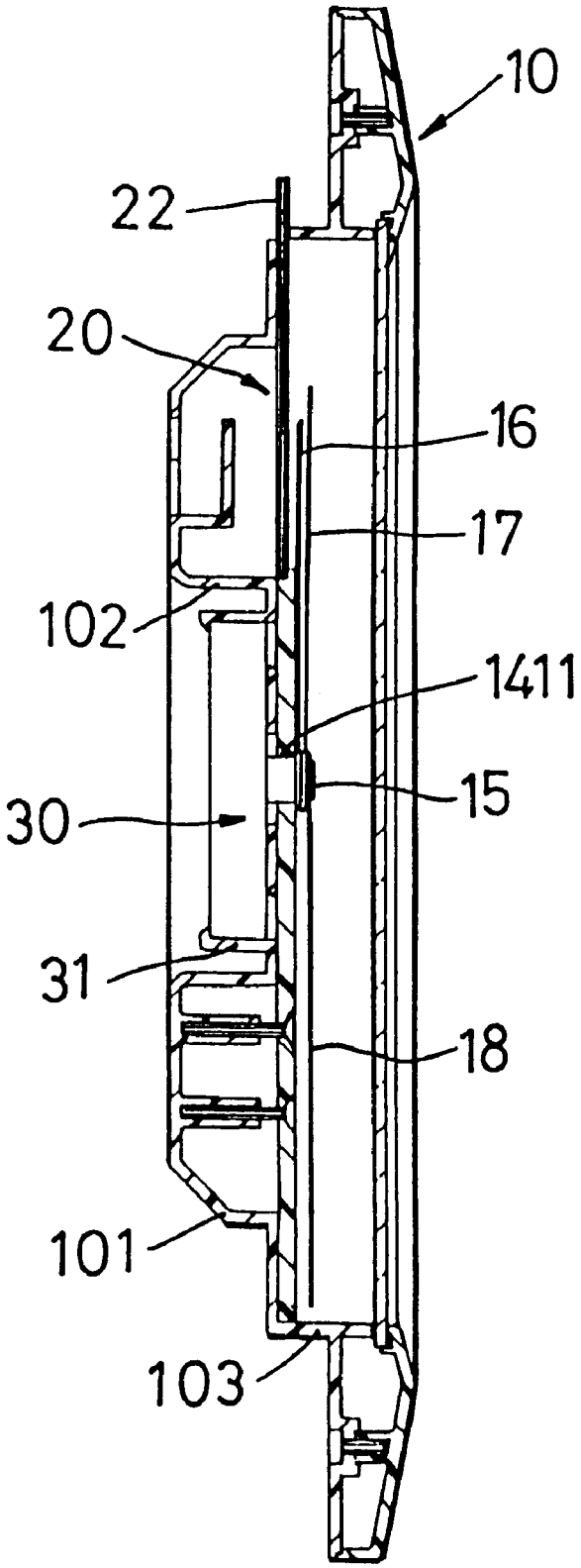
FIG. 4 is a sectional view of the first preferred embodiment.

Referring to FIGS. 1 and 4, the first preferred embodiment of the clock according to the present invention is shown to comprise a circular housing 10 which has a rear wall 101 with a central area 102, and a surrounding wall 103 that extends forwardly from a periphery of the rear wall 101 and in an axial direction so as to cooperate with the rear wall 101 to confine a receiving space 11. A slit 12 is formed in an upper side of the housing 10, and extends along about half of the surrounding wall 103 in a plane to which the axial direction is normal. The slit 12 terminates with two limiting portions 121. A clock mechanism 30 has a casing 31 which is fixed on the central area 102 in the receiving space 11, a spindle 15 which is rotatable relative to and which extends outwardly of the casing 31 with an axis normal to the plane, and an hour hand 16, a minute hand 17 and a second hand 18 which are mounted on the spindle 15.

An elongated positioning member 14 is fixed to a lower side of the housing 10 opposite to the slit 12 diametrically, and includes an abutment portion 141 which is disposed above the casing 31 and which has a through hole 1411 for passage of the spindle 15 therethrough along the axis. An anchoring portion 13 extends from the abutment portion 141 in a radial direction relative to the axis, and has right and left lateral sides 131 opposite to each other and parallel to the radial direction to serve as two guideways. Two flanges 132 project respectively from the right and left lateral sides 131.

Figure 2:
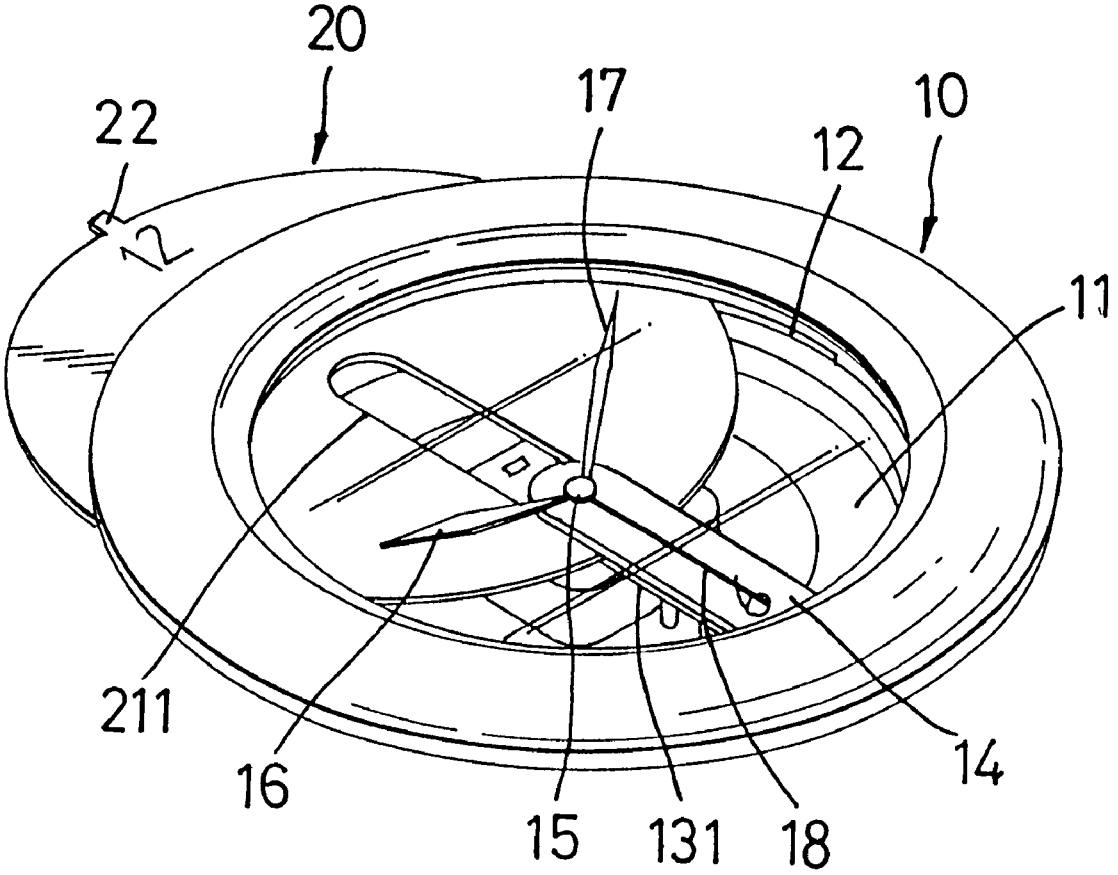
FIG. 2 is a perspective view showing how a dial plate of the first preferred embodiment is inserted into a housing.

A circular dial plate 20 has an outer periphery 23 of such a dimension so as to be insertable into the receiving space 11 via the slit 12 and along the plane. The dial plate 20 further has a notch 21 which is concaved inwardly and in the radial direction from the outer periphery 23, and which is confined by two inner edge portions 211 and an intersecting portion 212 between the inner edge portions 211. The inner edge portions 211 are disposed opposite to each other and are parallel to the radial direction so as to serve as sliding portions for mating respectively with the right and left lateral sides 131, as shown in FIG. 2. A tab 22 extends outwardly of the outer periphery 23 at a position distal to the notch 21 relative to the radial direction. In addition, two protruding portions 231 are formed on the outer periphery 23 and are opposite to each other diametrically.

Figure 3:
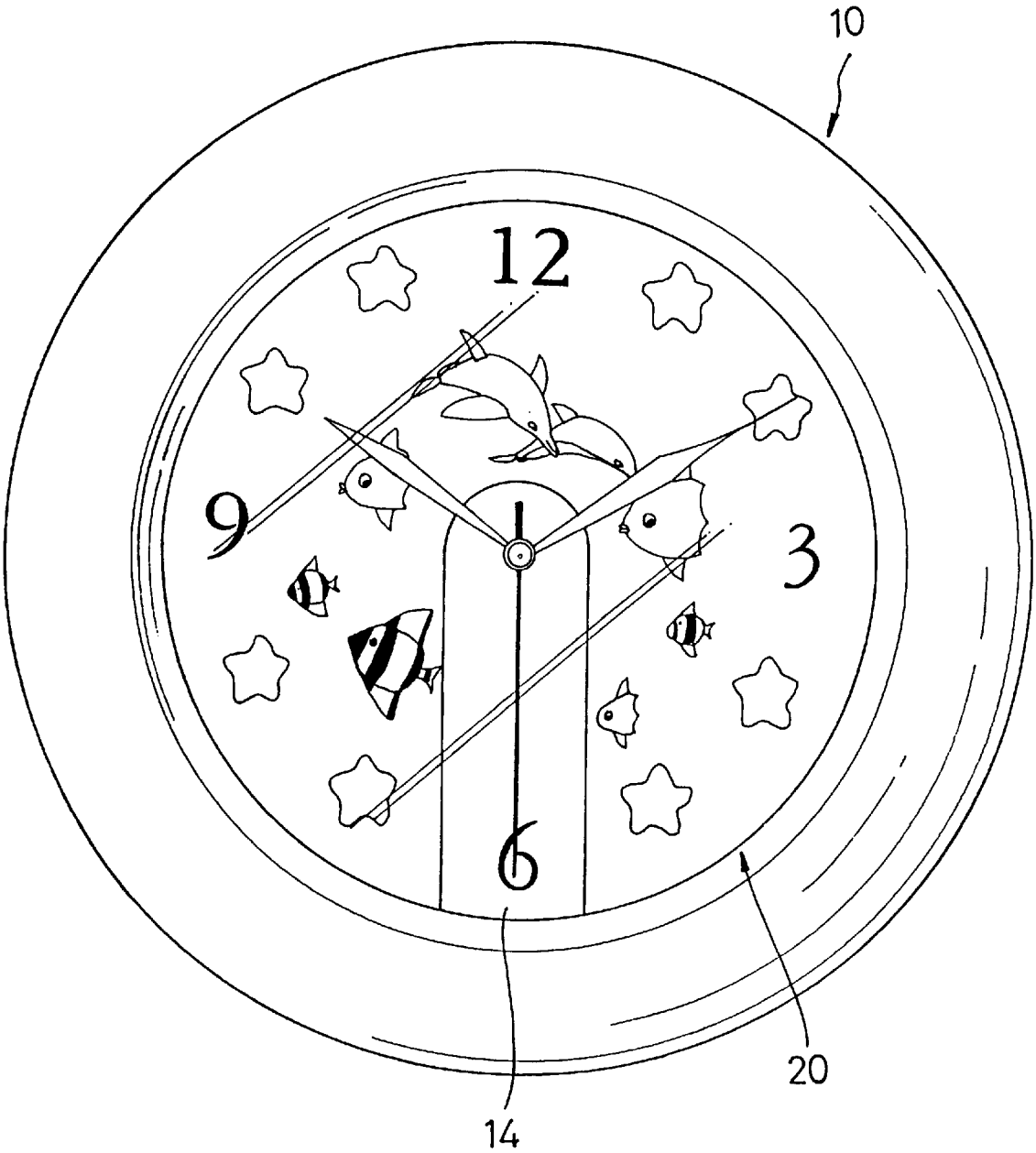
FIG. 3 is a front view of the first preferred embodiment.

As such, referring to FIGS. 2 and 3, the dial plate 20 can be inserted into the receiving space 11 via the slit 12 in such a manner that the inner edge portions 211 engage slidably and respectively the right and left lateral sides 131 for guiding the insertion of the dial plate 20 in the radial direction. After the entire dial plate 20 has been inserted into the receiving space 11, the tab 22 remains out of the housing 10. Moreover, the protruding portions 231 abut against the limiting portions 121, and the intersecting portion 212 abuts against the abutment portion 141 so as to retain the dial plate 20 in the receiving space 11.

Figure 5:
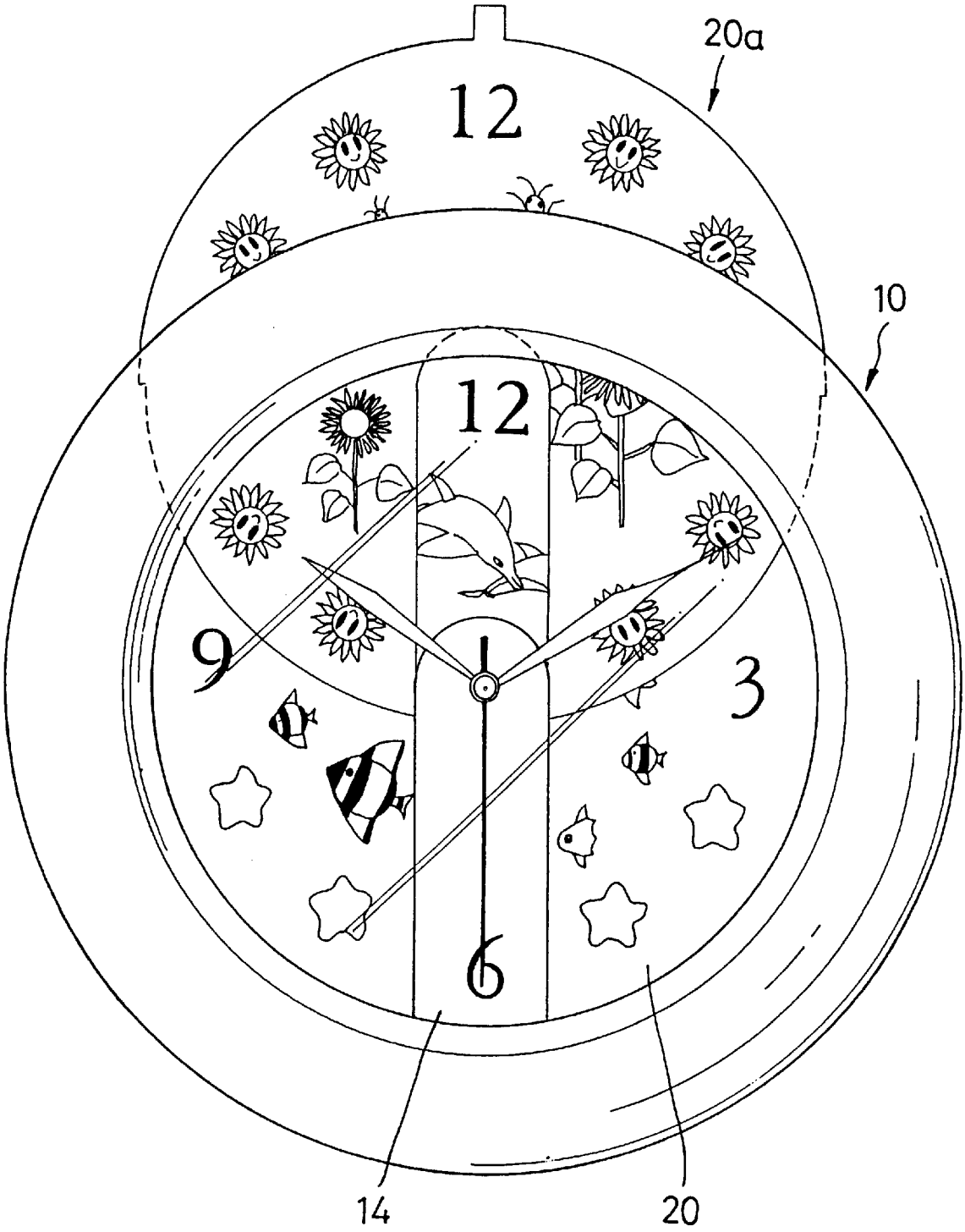
FIG. 5 is a schematic view showing how another dial plate is inserted into the housing of the first preferred embodiment.

Referring to FIG. 5, when it is desired to replace the dial plate, another dial plate **20*a* can be inserted into the receiving space 11 via the slit 12, and is placed forward of the dial plate 20. Alternatively, the user can pull the dial plate 20** outwardly from the receiving space 11 by gripping the tab 22, and then insert another dial plate 20*a* into the receiving space 11 in the above manner.

Figure 6:
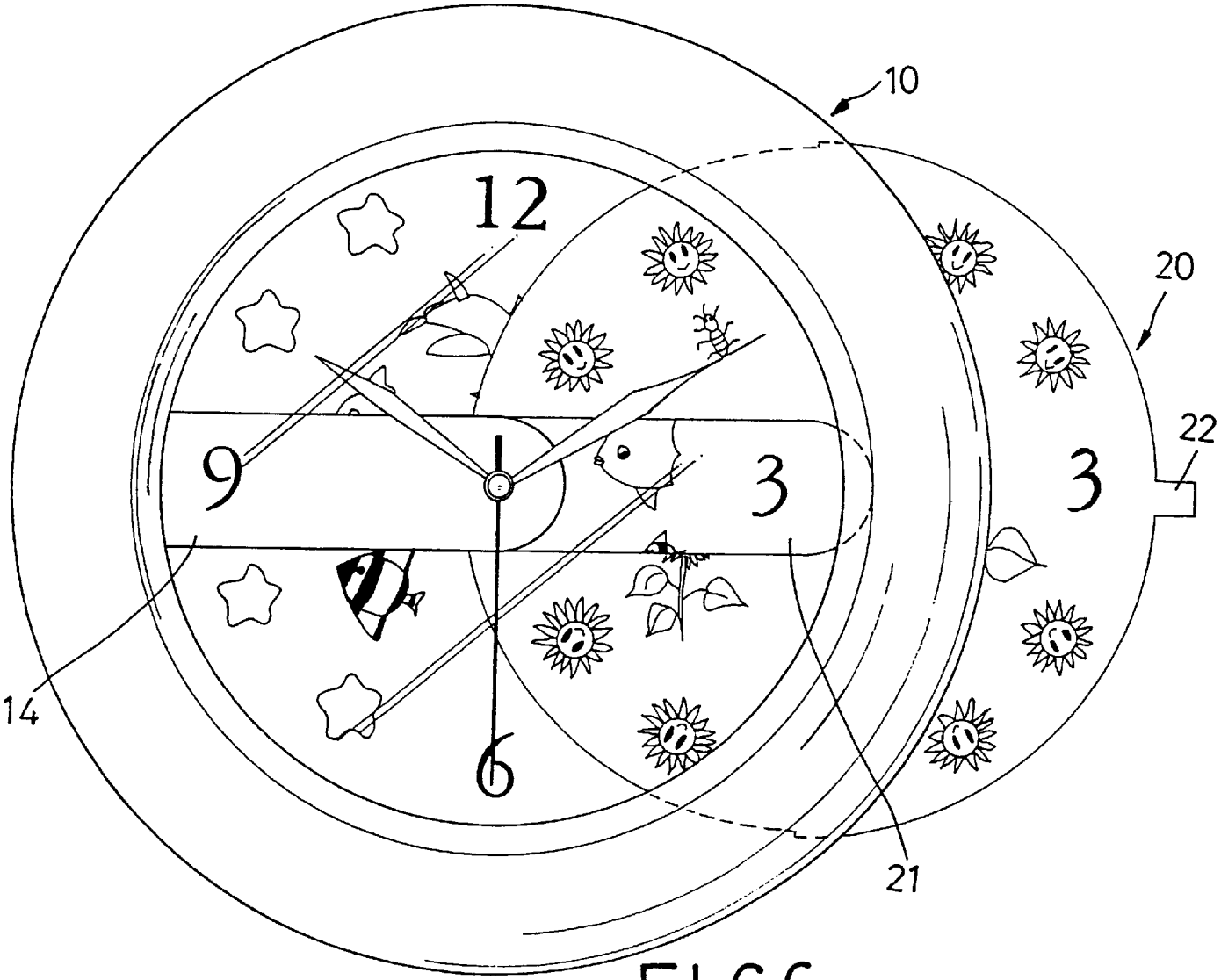
FIG. 6 is a front view of a second preferred embodiment of the clock according to this invention.

Of course, referring to FIG. 6, the positioning member 14 can be disposed at a left or right side of the housing 10, and the slit 12 can be disposed at the right or left side to correspond to the positioning member 14.

Figure 7:
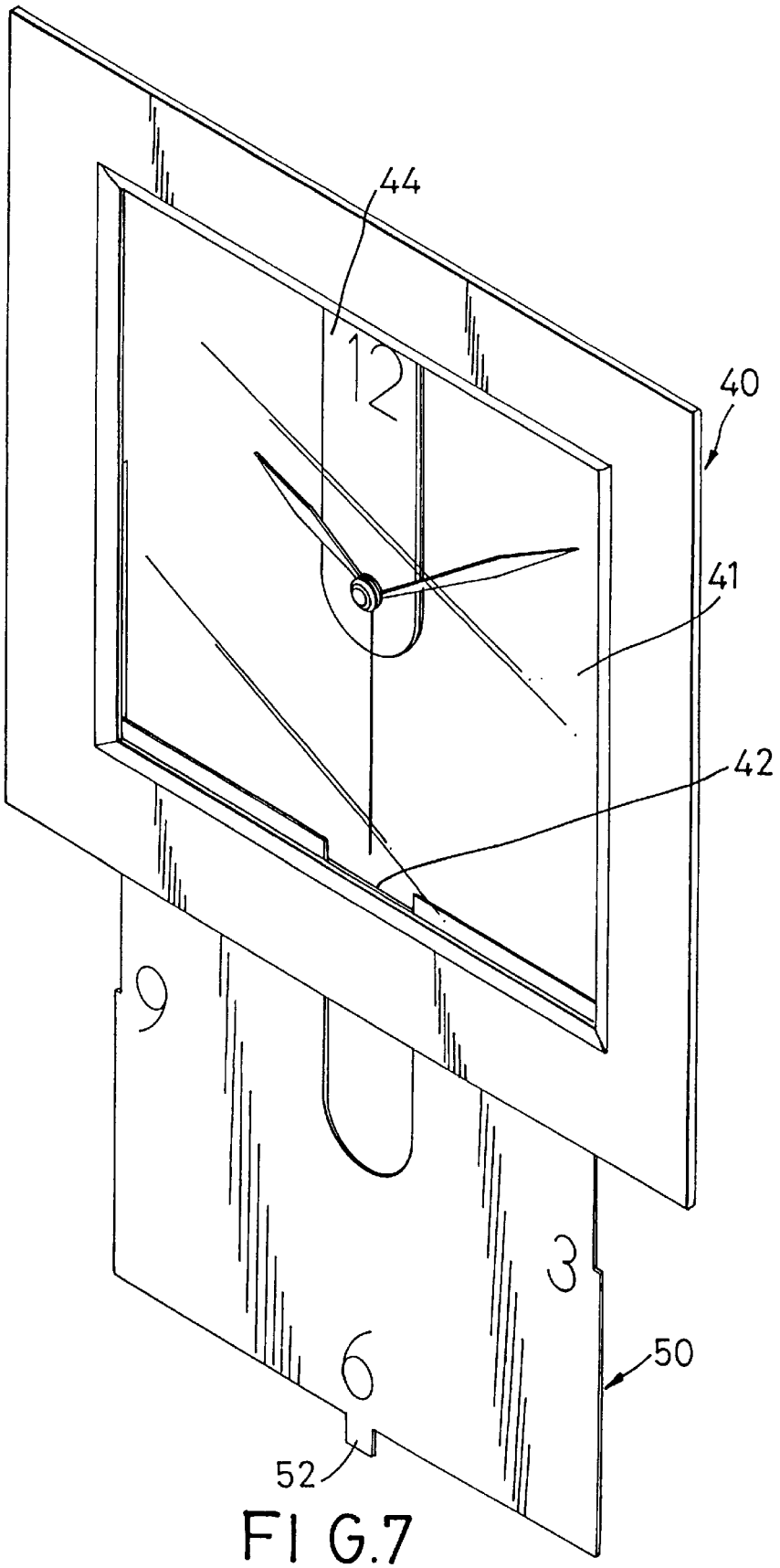
FIG. 7 is a front view of a third preferred embodiment of the clock according to this invention.
Figure 8:
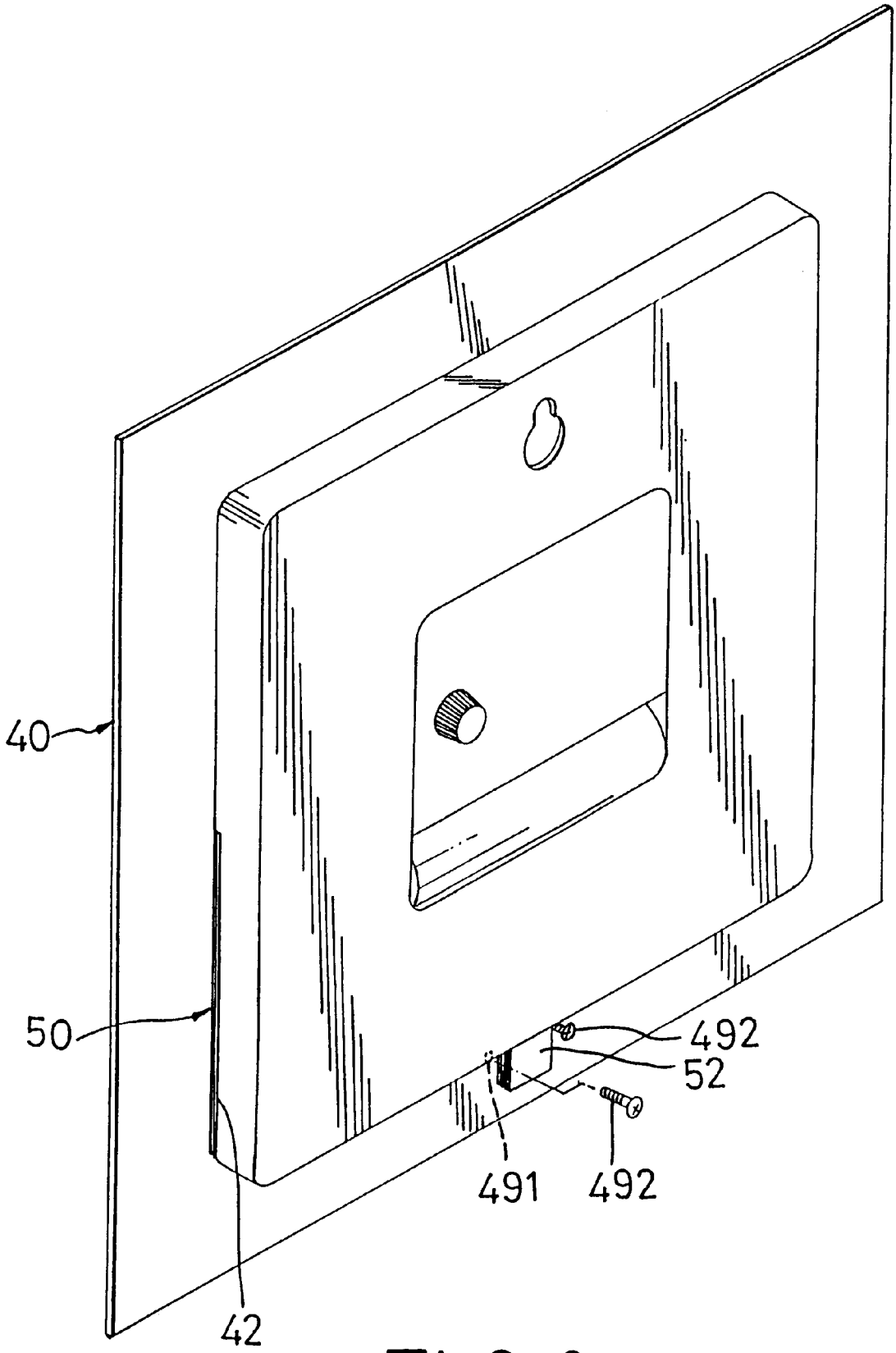
FIG. 8 is a rear view of the third preferred embodiment, showing how a dial plate is retained in a housing of the clock.

Referring to FIGS. 7 and 8, the third preferred embodiment of the clock of this invention has the housing 40 and the dial plate 50 of a rectangular shape. Two screw holes 491 are formed in the rear wall of the housing 40 adjacent the slit 42 distal to the positioning member 44 relative to the radial direction, and are spaced apart from each other in a direction transverse to the radial direction. Thus, after the dial plate 50 is inserted into the receiving space 41 via the slit 42, two screw bolts 492 are inserted respectively into the screw holes 491 so that the tab 52 can be inserted between the screw bolts 492 to retain the dial plate 50 in the receiving space 41.

Figure 9:
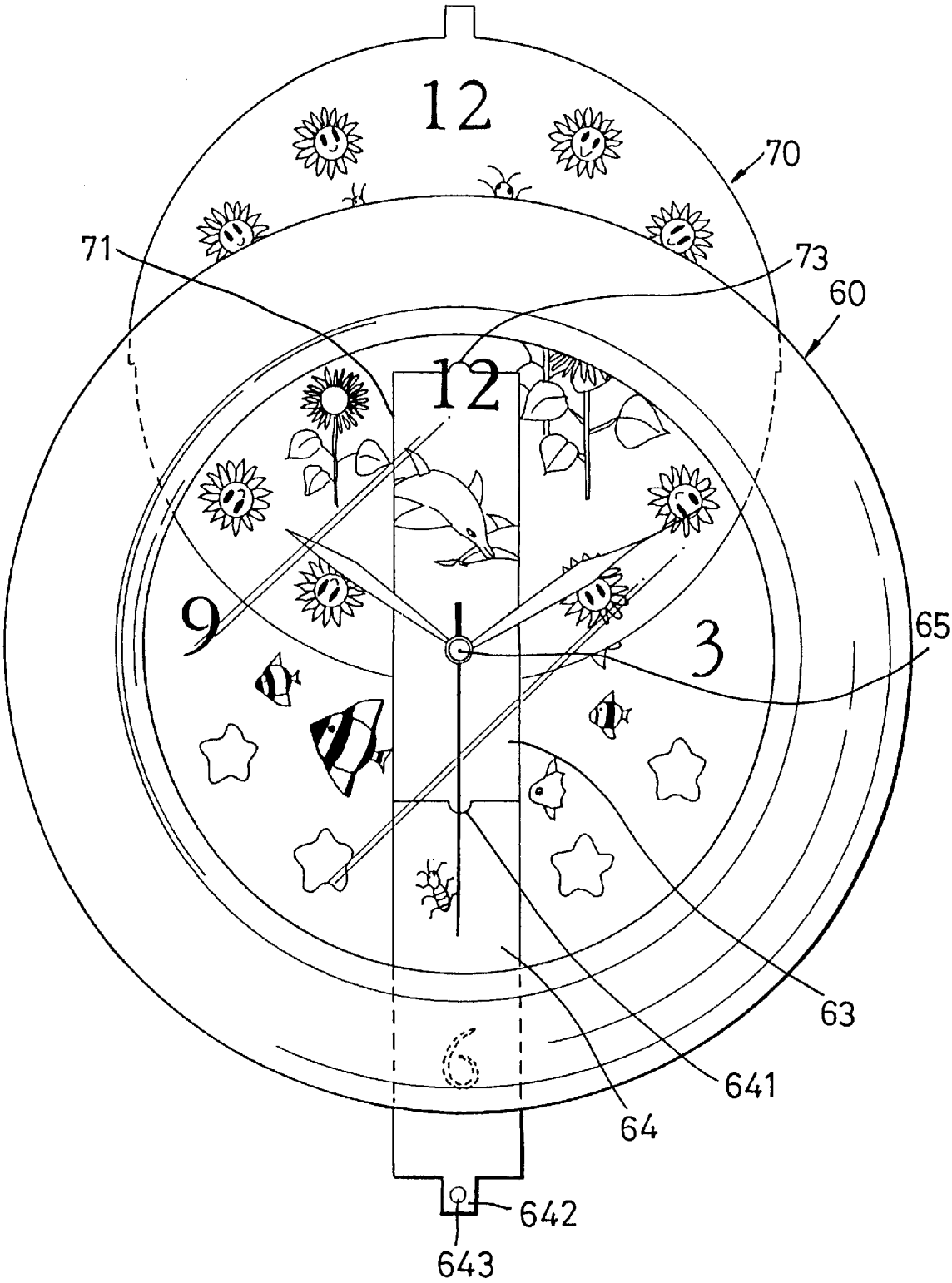
FIG. 9 is a front view of a fourth preferred embodiment of the clock according to this invention.
Figure 10:
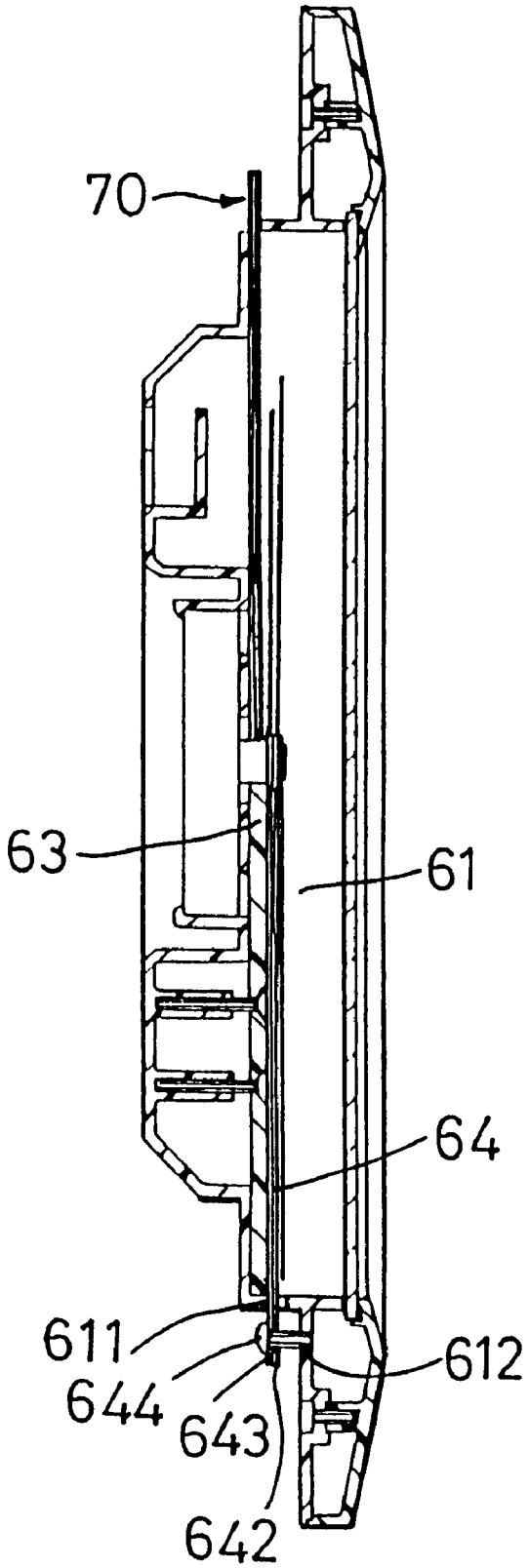
FIG. 10 is a sectional view of the fourth preferred embodiment.

FIGS. 9 and 10 show the fourth preferred embodiment of this invention, wherein, in addition to the components of the first preferred embodiment, the housing 60 has an insert slit 611 which is formed in a lower side thereof, a screw hole 612 which is formed under the insert slit 611. A decorative plate 64 is inserted into the receiving space 61 of the housing 60 via the insert slit 611, and has a tab 642 with a hole 643. Thus, a screw bolt 644 is inserted into the hole 643 and the screw hole 612 to retain the decorative plate 64 in the receiving space 61 and positioned on the positioning member 63. It is noted that the decorative plate 64 can be pulled outwardly from the receiving space 61 by gripping the tab 642 after the screw bolt 644 is disassembled. In addition, the intersecting portion of the notch 71 and the decorative plate respectively have semi-circular concaved portions 73,641 to confine a through hole for passage of the spindle 65. As such, in this embodiment, the dial plate 70 and the decorative plate 64 can be replaceable.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A clock comprising:

a housing having a rear wall with a central area, a surrounding wall extending forwardly from a periphery of said rear wall and in an axial direction to cooperate with said rear wall to confine a receiving space, and a slit extending along a portion of said surrounding wall in a plane to which said axial direction is normal;

a clock mechanism having a casing fixed on said central area in said receiving space, and a spindle rotatable relative to and extending outwardly of said casing with an axis normal to said plane;

an elongated positioning member including an abutment portion which is disposed above said casing and which has a through hole for passage of said spindle therethrough along said axis so as to be adapted for mounting time indicating hands thereon, and an anchoring portion which extends from said abutment portion in a radial direction relative to said axis, and which has right and left lateral sides opposite to each other and parallel to said radial direction;

at least one dial plate having an outer periphery of such a dimension so as to be insertable into said receiving space via said slit and along said plane, and an inner periphery extending inwardly and in said radial direction from said outer periphery to confine a notch with two inner edge portions opposite to each other and parallel to said radial direction so as to mate respectively with said right and left lateral sides of said anchoring portion;

means for guiding said inner edge portions to engage slidingly and respectively said right and left lateral sides when said dial plate is brought to be inserted into said receiving space in said radial direction; and means for retaining said dial plate relative to said anchoring portion in said receiving space once said inner edges portions have engaged said right and left lateral sides, respectively.

2. The clock as claimed in claim 1, wherein said guiding means includes two guideways disposed respectively along said right and left lateral sides, and two sliding portions disposed respectively along said inner edge portions to slide respectively on said guideways in said radial direction.

3. The clock as claimed in claim 1, wherein said dial plate further has a tab extending outwardly of said outer periphery at a position distal to said notch relative to said radial direction so as to project outwardly from said surrounding wall of said housing to facilitate gripping when replacement of said dial plate is required.

4. The clock as claimed in claim 1, wherein said slit terminates at two limiting portions, said retaining means including two protruding portions which extend outwardly from said outer periphery of said dial plate so as to abut respectively against said limiting portions once said inner edge portions have been brought to mate with and engage respectively said right and left lateral sides.

* * * * *